United States Patent [19]

Uzdy

[11] Patent Number: 4,588,098

[45] Date of Patent: May 13, 1986

[54] CLOSURES FOR CONTAINERS HAVING TAMPERING INDICATING MEANS

[76] Inventor: Zoltan Uzdy, 14206 Summertime La., Culver City, Calif. 90230

[21] Appl. No.: 696,999

[22] Filed: Jan. 31, 1985

[51] Int. Cl.[4] ..... B65D 55/02

[52] U.S. Cl. ..... 215/230; 215/203; 215/250

[58] Field of Search ..... 215/201, 203, 250, 230

[56] References Cited

U.S. PATENT DOCUMENTS 4,458,820 7/1984 Abrams ..... 215/250

*Primary Examiner*—George T. Hall

*Attorney, Agent, or Firm*—Roger A. Marrs

[57] ABSTRACT

A closure cap is disclosed herein having a double latch closure system for controlling the rotation of the cap on a container and which includes an angular displaceable indicating marker for signifying unauthorized container opening. In one form, the cap includes a first container closure portion having upright, spaced apart driven segments and a second cover portion rotatably mounted on the first portion having downwardly depending driving segments interposed between selected ones of the driven segments so that clockwise or counterclockwise rotation of the cover portion translates into rotation of the closure portion via engagement of the driving segments with the driven segments. A pair of markers carried on the exterior of the closure and cover portion cooperate to indicate displacement of the cover portion from its initial or original position.

7 Claims, 14 Drawing Figures

FIG. 1
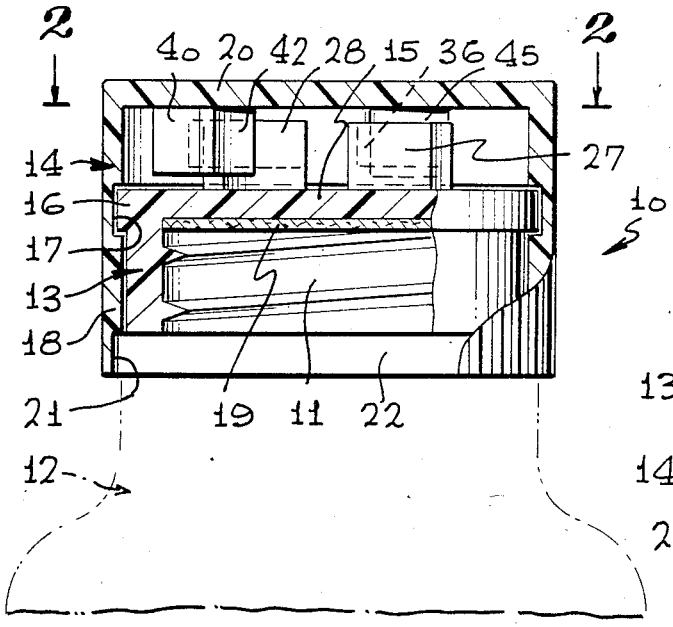
FIG. 2
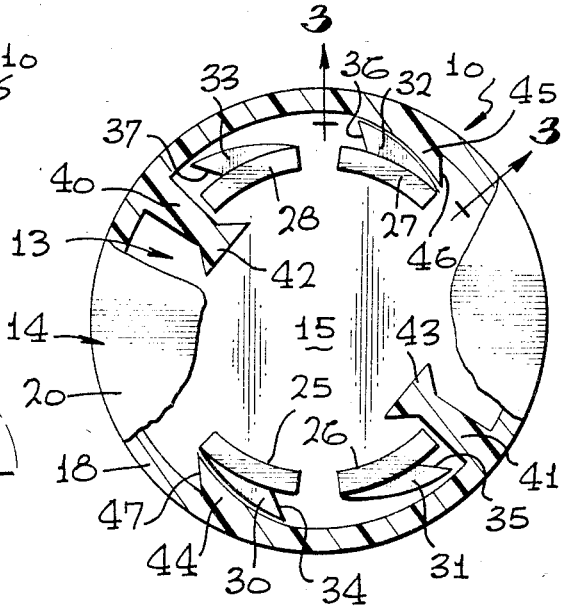
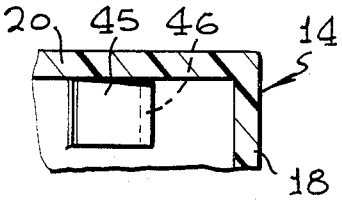
FIG. 3
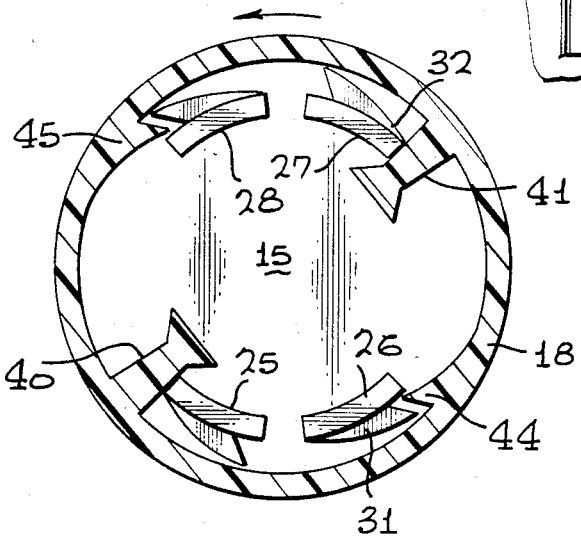
FIG. 4
FIG. 5
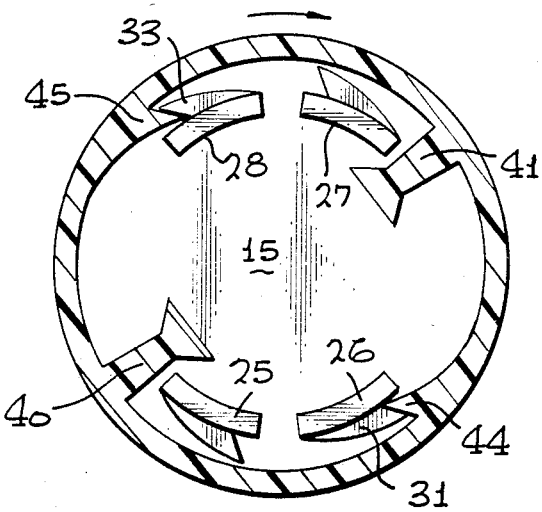

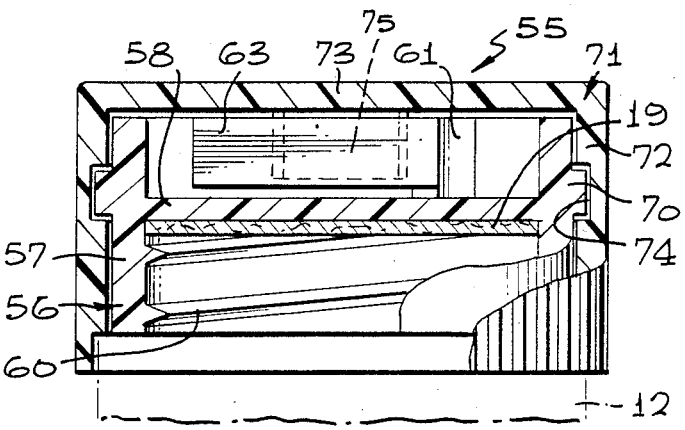
FIG. 6
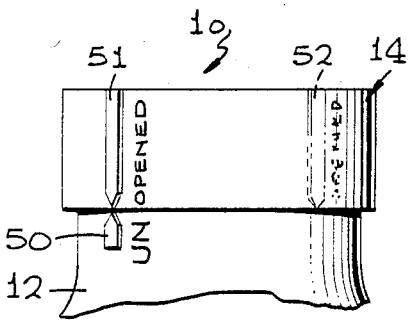
FIG. 5a
FIG. 7
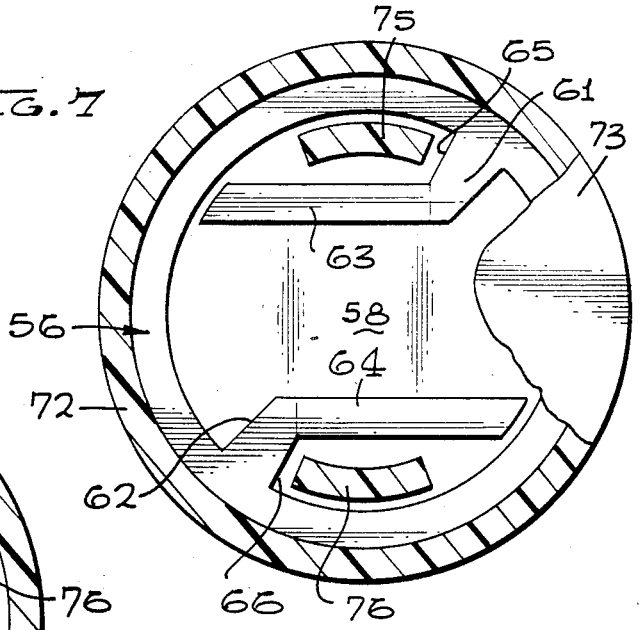
FIG. 8
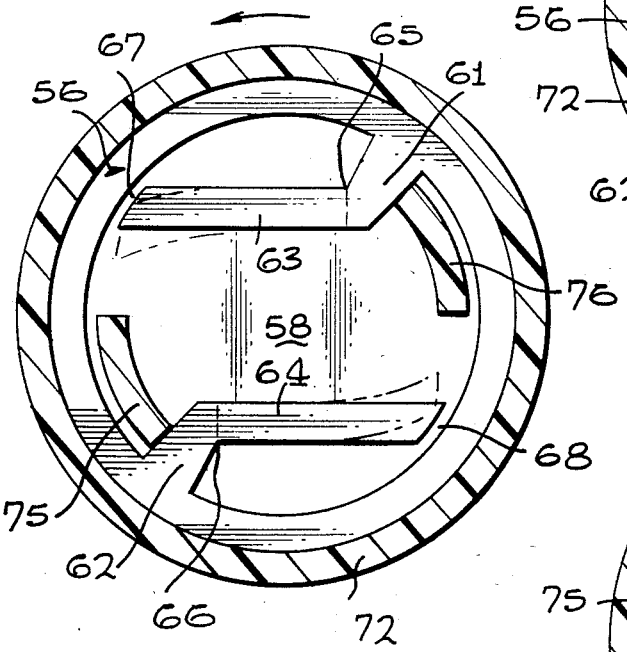
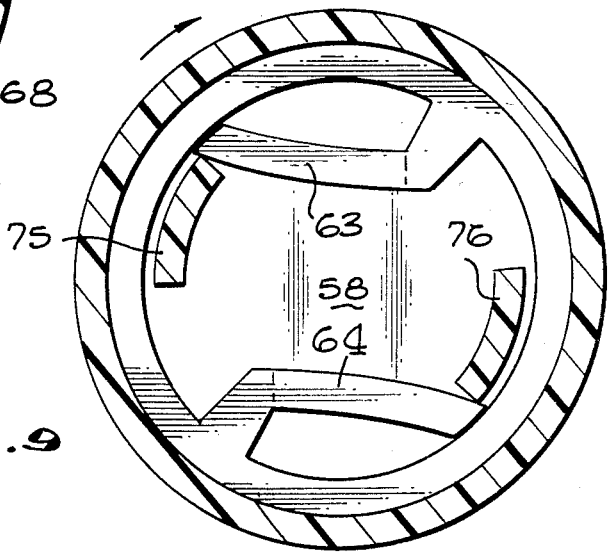
FIG. 9

CLOSURES FOR CONTAINERS HAVING TAMPERING INDICATING MEANS

BACKGROUND OF THE INVENTION

1. Field of the Invention

The present invention relates to cap closures for sealed containers and, more particularly, to such a closure having a two-position cap assembly providing visual and physical indication of unauthorized or attempted entry into the container.

2. Brief Description of the Prior Art

In the past, it has been the conventional practice to store a variety of items such as tablets, pills, capsules or the like in screw-on containers such as bottles utilizing a threaded cap engageable with a threaded container neck. A compressible sealing disc may or may not be attached to the inside of the cap. There are instances when the sealing disc omitted, especially if the cap is made from a plastic material and encloses dry goods such as pills and capsules. A sealing disc is mandatory for caps used on containers holding liquids or wet materials and is usually used in caps made from metal. In other instances, an additional seal is used in the form of a thin paper disc or metal foil wherein the seal is fixed to the rim of the container neck requiring removal in order to gain access to the contents. Furthermore, so-called "child proof" caps have been used to seal potent contents that employ cap assemblies utilizing a form of basic, inner cap and in addition incorporates a freely rotating, concentric, outer part that is used to engage and unscrew the basic cap part.

Although the above prior cap assemblies have been effective for sealing and somewhat restricting entrance to the contents of a container, difficulties and problems have been encountered which stem largely from the fact that no indication is presented which would signify unauthorized entrance or an attempt to gain entrance to the contents. In many instances, container caps have been removed and adulterating substances have been placed inside the container followed by reassembly of the cap closure so as to hide or conceal the adulterating attempt. Once the cap closure has been returned to the container, neither mechanical, physical nor visual indication is provided which would alert a subsequent user to the fact that a supposedly unopened container has previously been opened.

Therefore, a long standing need has existed to provide a novel cap closure for screw-on containers indicating that the cap closure has been removed by persons who may have tampered with the contents and then replaced the cap on the container. Such a cap closure means should not only be physically discernible to subsequent users of the container contents but should include visual indication for ready identification of the cap and container condition.

SUMMARY OF THE INVENTION

Accordingly, the above problems and difficulties are obviated by the present invention which provides a novel closure cap for containers providing a clear and identifiable indication or warning marker that an unauthorized opening or attempted opening of the container has been tried which comprises a closure assembly having a threaded closure portion carried on the container and a cover portion rotatably carried on the closure portion in coaxial relationship and displaying indicating means cooperatively disposed between the two portions defining an initial, unopened position and an unauthorized and open position. The assembly includes a double latch arrangement operably disposed between the cover portion and the closure portion of the assembly for controlling the rotation of the cover and the closure portion. In one version, the double latch mechanism includes upright spaced, apart driven segments on the closure portion which are driven by downwardly depending segments included on the underside of the cover portion. Clockwise or counterclockwise movement of the cover portion urges the closure portion to rotate in selected direction via engagement of the respective drive and driven segments. Since there is substantial circumferential difference between the initial position and the open position, an opening or attempted opening of the container is clearly identified and visual and physical indication is presented.

In other versions of the invention, resistance is generated to the rotation of the cover with respect to the closure portion so that complete opening of the closure means can be effected only by those persons having the strength to override the resistance. Such yieldable resistance means is in addition to the indicating means for disclosing an unopened or opened container.

Therefore, it is among the primary objects of the present invention to provide a novel cap closure for screw-on type containers which includes an indicating means for visually and physically indicating the condition of a closed container as to whether or not the container has been previously opened.

Still another object of the present invention is to provide a novel cap closure having marker means carried on the container and cap closure for indicating when the container has been opened.

Another object of the present invention is to provide a novel screw-on closure cap for containers having a yieldable resistance to open and which further includes indicating means for defining an initial unopened condition of the container and an attempted or opened condition of the container.

Yet a further object of the present invention is to provide a novel cap closure for screw-on containers having wide applications which are useful in overcoming unauthorized container opening problems.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a transverse cross-sectional view of the novel cap closure assembly incorporating the present invention;

FIG. 2 is a sectional view of the closure shown in FIG. 1 as taken in the general direction of arrows 2—2 thereof illustrating the drive segments in the initial position before first opening;

FIG. 3 is a cross-sectional fragmentary view of a drive segment taken in the direction of arrows 3—3 of FIG. 2;

FIG. 4 is a view similar to the view of FIG. 2 illustrating the segments in position for driving the cap closure in a counterclockwise direction to open and gain access to the container;

FIG. 5 is a view similar to the view of FIG. 4 ilustrating the segments in position for driving the closure portion in a clockwise direction for closing the container after it has been initially opened;

FIG. 5*a* is a front elevational view of the closure assembly and container showing indicating means for visually and physically signifying two positions representing initially unopened and opened conditions applicable to the container;

FIG. 6 is a transverse cross-sectional view of another embodiment of the present invention including indicating means for signifying initially unopened and opened condition of the container;

FIGS. 7, 8 and 9 are cross-section views showing various alignment of wedges in connection with rotation of the cover with respect to the closure portion of the embodiment shown in FIG. 6;

DESCRIPTION OF PREFERRED EMBODIMENT

Figure 10:
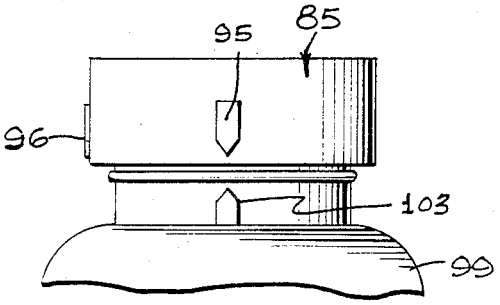
FIG. 10 is a front elevational view showing the indicator means for another version of the cap closure assembly shown further in FIGS. 11, 12 and 13 inclusive.
Figure 12:
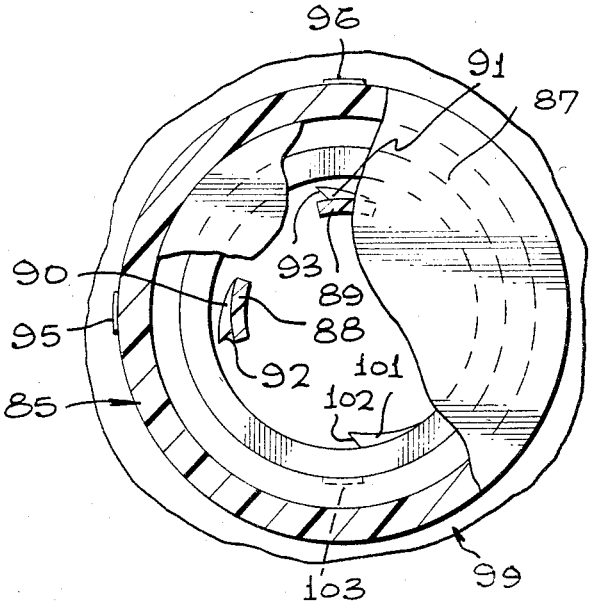
FIGS. 11–13 inclusive show the other version of the present invention.

Referring to FIGS. 1 and 2, the novel cap closure assembly of the present invention is illustrated in the general direction of arrow 10 which is illustrated in threadable contact with a neck 11 of a container such as a bottle 12. The assembly 10 includes an inner cylindrical closure portion 13 having a threaded recess for engaging with the threaded neck 11 of the container and an outer or cover portion 14 which encloses the inner portion 13 and serves as a finger grasping element so that the assembly can be rotated by the user on and off of the container 12.

The inner portion 13 may be referred to as a closure portion that includes a wall 15 serving as the bottom of the threaded recess which terminates in a circular flange 16 which is of rectangular cross-section. The flange 16 is received within an annular groove 17 provided in the inside wall surface of a cylindrical wall 18 of the outer or cover portion 14. A wall 20 closes the cavity occupied by the inner or closure portion 13 and is integral with the cylindrical wall 18. Wall 18 further terminates at its open end leading into the interior cavity with a shouldered cut-out 21 adapted to receive and bear against a circular flange 22 integrally carried on the bottle or container 12. A thin circular sealing disc 19 initially secured to the wall 15 is disposed between the opposing surfaces of the wall 15 of the inner or closure portion 13 and the surface of the neck 11 of container 12. As illustrated in FIG. 1, the cap assembly 10 is tightened and sealed so that the disc 19 is compressed and the recessed or shouldered groove 21 of the wall 18 makes sealing contact with the upper face of the shoulder or band 22 so as to obtain an outer seal.

Referring now in further detail to FIGS. 1 and 2, it can be seen that a cavity is established between the opposing surfaces of walls 15 and 20 associated with the respective cover portion and closure portion. The cavity is maintained by the flange 16 when inserted within the annular groove 17. The cavity is occupied by a plurality of segments which form a double-latch or drive system for effecting the removal of the closure portion 13 from the neck of bottle 11. The variety of segments are arranged to engage and disengage in driving and driven relationship depending upon the clockwise or counterclockwise rotation of the cover portion 14 with respect to the closure portion 13. The closure portion 13 includes a plurality of upright arcuate segments identified by numerals 25, 26, 27 and 28 which are integrally formed with and project upwardly from the closure portion wall 15 in fixed spaced apart relationship. As seen more clearly in FIG. 2, the segments 25–28 are arranged in pairs so that segments 25 and 26 form one pair in base relationship to each other and wherein segments 27 and 28 form an additional pair in spaced relationship while both pairs are disposed in substantially further spaced apart relationship with respect to each other. It is noted that the segments are arcuate and that they lie on a circle line coaxially disposed with respect to both the cover portion and closure portion. The segments 25–28 inclusive have wedges 30, 31, 32 and 33 respectively on their outward facing sides with slightly convex curvature terminating in acute angles or faces 34, 35, 36 and 37 respectively. All of the wedges extend vertically part of the way down their respective segments and taper rapidly at the base of each segment to a thickness of the segment itself. The segments pairs are diametrically opposed with respect to each other and the closure portion 13 is composed of a pliable or flexible material. Since the segments are relatively short in arc length with a thickness at the base being of relatively narrow thickness as compared to the upper portion of the segments, the segments require little force to bend or deflect inwardly. These features are of importance when intial assembly takes place of the cover portion 14 with the closure portion 13.

The cover portion 14 of the cap assembly 10 includes a plurality of driving segments taking the form of a pair of opposing projections 40 and 41 integrally carried on the inner wall surface of walls 18, 20 which flare out into triangular ends 42 and 43 that terminate each of the respective projections. The projections are integral with the inside of walls 18,20 and extend part of the way down the inside surface of the wall 18. A pair of wedges 44 and 45 are integral with the walls 18, 20 and terminate in acute angles 46 and 47 respectively in a similar manner to the angles 34–37 associated with the wedges 30–33 carried on the segments 25–28 inclusive. However, the wedge faces 46 and 47 have a slightly concave slope. The wedges 44 and 45 are substantially identical and diametrically opposite to each other as are the projections 40 and 41. Therefore, the wedges 44 and 45 as well as the projections 40 and 41 are arranged in fixed spaced apart relationship and are of substantially equal distance from one another. The outer or cover portion 14 is composed of a rigid and hard material since the portion must protect and shield the inner or closure portion 13 from mechanical forces and deformation which may be encountered.

With respect to FIG. 3, the wedge 45 with its angular face 46 is illustrated integral with both the wall 20 and the wall 18 so that a notch or recess is provided between the face 46 and the opposite or opposing surface of the wall 18. Such a notch is intended to be occupied by the wedge 33 during clockwise rotation of the cover portion 14.

Initially, the cover and closure portions are assembled by first correctly aligning the portions as shown in FIG. 2 and then press fitting the portions together into the assembly 10. The flexible closure portion 13 bears most of the momentary deformation until the press fitting operation is complete and this occurs before projection or flange 16 expands into mating groove 17. The combination of the flange or projection 16 and groove 17 holds the portions together as well as providing a rotational guide for the cover portion 14. There is sufficient clearance between the flange and groove so that the outer or cover portion 14 can rotate freely guided by projection or flange 16. The flange 16 should extend into groove 17 as much as practical considerations will allow since this will make it difficult to separate the portions even with the use of tools. The alignment of the portions shown in FIGS. 1 and 2 also prepares the driving and driven mechanisms embodying the projections in respective segments to generate the warning indication.

The cap assembly 10 as shown in FIGS. 1 and 2 is illustrated as being screwed onto a typical container 12 used for storing pills and capsules as examples. The container typically has only a single turn, fairly coarse thread on the outside of neck 11 and the cap assembly 10 unscrews in less than one turn. It is to be noted that the container 12 includes the band 22 which is more prominent than is usually provided and the band or rim is of rectangular cross-section. This band serves a dual purpose. First, the band seals the closure portion of the cap assembly from outside environment by filling the gap normally provided on conventional closure caps between the outer or cover portion 14 and the neck 11 of the container. It is vital for the intent of the present invention that the closure portion 13 be completely isolated from the external environment. If band 22 were not there, a sharp instrument could be stuck into the exposed lower edge of the inner part, possibly enabling the cap assembly to be turned as a single unit defeating the inner mechanism. To reduce any accessibility to sharp instruments, band 22 can be made to extend into a small recess 21 in the terminating end of wall 18 of the cover portion 14. Another purpose for the band 22 is to provide mechanical support to the open end of the wall 18 if the latter is subjected to large outside pressure. The support of band 22 is an added safeguard to prevent deformation of the lower part of wall 18 if it is subjected to great pressure, possibly gripping the closure portion 13 with sufficient frictional force so that the two cylindrical portions are locked together and can be unscrewed as a single unit thus defeating the warning mechanism. Band 22 prevents inward movement of the lower edge of circular wall 18 thus preventing this possibility. When the cap assembly is screwed on and tightened to the neck 11, compressible disc 19 is pressed tightly over the container opening at the top end of neck 11 so as to seal the container and firmly locking the closure portion 13 thereto.

A slight modification to the cap assembly as used in this version as well as other versions is required if it is to be adapted for sealing commonly available jars. The neck of a typical jar is quite short and the band associated therewith is of rounded cross-section with little projection. The modification to the cap assembly is simply to extend the wall 18 straight so as to omit the recess 21 so that when the cap assembly is screwed on, contact or near contact is made with the jar body so as to protect and prevent access to the closure portion 13.

In actual use, the two portions 13 and 14 of the cap are assembled as shown in FIG. 1. The cap assembly 10 of FIG. 1 is screwed onto the filled container and firmly tightened at the initial closing by rotating cover portion 14 clockwise from the position shown in FIG. 2. During this phase, projections 40 and 41 press against segments 26 and 28 respectively imparting clockwise rotation to inner or closure portion 13. After inner portion 13 has been securely tightened, cylinder or wall 18 should contact, or nearly contact, band 22. In either case, the initial position of outer portion 14 is defined within narrow limits because free movement is prevented in the clockwise direction by contact between projection 40 and segment 28 and projection 41 and segment 26 respectively, and in the counterclockwise direction by contact between the faces of wedges 30, 44 and 32, 45 respectively.

The operation of the cap assembly mechanism at the first opening will now be described. The initial position of the cap assembly is that shown in FIG. 1. To open the container, the outer cover portion 14 is first rotated in a counterclockwise direction. Wedge 44 begins to slide over wedge 30, at the same time bending segment 25 inwards. Segment 25 can bend inwards with relative ease for reasons stated previously. Because inner portion 13, to which segment 25 is attached, has been securely tightened initially, the small rotational force imparted to segment 25 by the sliding action of the wedges is insufficient to cause movement or rotation of the inner portion 13 at this stage. Continuing the counterclockwise rotation of outer portion 14 causes wedges 30, 44 to slide past each other, at which point segment 25 snaps back to its original position. The above description applies also to the corresponding wedge pair 32, 45 and occurs substantially simultaneously. Continuing counterclockwise rotation causes the above procedure to be repeated as wedge 44 slides past wedge 31 and simultaneously wedge 45 slides past wedge 33. The situation is now as shown in FIG. 4, with projection 41 making contact with segment 27 and projection 40 making contact with segment 25. Since projections 40, 41 are attached both to the inside of wall 18 and top wall 20, they are rigid structures. Continued application of counterclockwise rotational force to outer portion 14 causes force to be transmitted by projections 40, 41 to segments 25, 27 respectively. Segments 25, 27 are prevented from bending in the radial direction by the wall 18 on one hand, and by the sloping faces of triangular ends 42, 43 respectively on the other hand, during both the opening phase and the initial closing phase. Since segments 25, 27 are attached to wall 15, rotational torque is applied to inner portion 13 and the cap assembly unscrews and can be removed. The cap assembly is screwed on again by rotating the outer part 14 in a clockwise direction. Because of substantial overlap, the protruding ends of wedges 33, 45 and 31, 44 will interlock so that rotational torque is imparted to the inner part 13 via segments 28 and 26 respectively. The cap assembly is screwed back on via the mating threaded neck and cap parts and tightened, sealing the container again. The interlocking wedges during the closing operation are shown in FIG. 5. Outer part 14 is prevented from returning to its initial position and increasing the clockwise rotational force on outer part 14 simply locks the wedge pairs 33, 45 and 31, 44 more firmly together because of the acute angle design of their contacting faces. Comparing the initial and second position of outer part 14 in FIGS. 2 and 5 respectively, it is apparent that about 90° (close to a quarter turn) of permanent angular displacement of the outer part 14 (with respect to the inner portion 13) can be obtained. Since this angular displacement occurs only at the first opening of the container, it can be used as an indicator to warn of unauthorized opening or tampering. Once in this second position, unscrewing the inner part 13 will always be by contact between projections 40, 41 and segments 25, 27 respectively as shown in FIG. 4; tightening the inner part 13 will always be via the interlocking wedge pairs 33, 45 and 31, 44 as shown in FIG. 5.

The main purpose of segments 25, 27 with their respective wedges 30, 32 is to secure the outer part 14 in its initial position, acting in the manner of a brake as in FIG. 2. Because of the acute angles 34, 36 on wedges 25, 27, even an attempted opening or partial rotation of outer part 14 will be indicated if wedges 44, 45 move past wedges 30, 32 respectively. Return movement to the initial position will not be possible as wedge pairs 30, 44 and 32, 45 will interlock. If this partial displacement feature is not desired, it can be avoided by making wedge angles 34, 36 obtuse instead of acute so that wedges 44, 45 will not engage in the clockwise direction. Wedge angles 35, 37 must always be acute.

The large, permanent, rotational displacement of outer part 14 can be made externally visible to the user or purchaser of the container by graphics or indicia as shown in FIG. 5*a* which is a side view of the container 12 with the cap assembly in place. Graphic means such as an upward pointing arrow 50 can be embossed on the neck of the container 12. A similar downward pointing arrow 51 can be embossed on the external surface of outer part 14. When the cap assembly is firmly tightened at the initial closing, the arrows 50 and 51 are aligned as shown in FIG. 5*a* and they designate the initial position of FIG. 2. After the first opening, the permanent angular displacement of the outer part 14 is shown by the dotted image 52. The misalignment between 50 and 52 is clearly evident. It is desirable to have substantial (about a quarter turn) permanent angular displacement of the outer portion 14 which translates into a substantially identical misalignment between the arrows 50 and 51 for cap assemblies where an inner sealing disc 19 is used. Such a large displacement is an added safeguard if sealing disc 19 is removed in an effort to restore the alignment of arrows 50, 52 after unauthorized opening of the container. The removal of typical sealing discs from currently employed caps can result in an additional 20°–40° of clockwise rotation when the caps are screwed on again. In the case of the cap assembly, the removal of such sealing discs could reduce the available 80° angular displacement of outer part 14 to a net of 40°–60° still quite adequate for unmistakable misalignment of arrows 50, 51. There are two additional safeguards against sealing disc 19 removal. The first safeguard is cementing sealing disc 19 properly to the wall 15 with a strong adhesive. The second safeguard is outer portion wall 18 engaging with projection 22 or the jar or container body thus limiting clockwise rotation and leaving a gap where the sealing disc 19 was prior to its removal. To inform the user of the intended purpose of arrows 50, 51, a warning message such as "REJECT IF ARROWS DO NOT ALIGN" may be embossed on the outside of cap portion 14 or the container body. The cap assembly has been described here with a sealing disc 19; however, it can also be used without a sealing disc if desired.

Another embodiment of the invention will now be described which is functionally equivalent to the first embodiment of FIGS. 1 and 2, but which uses a completely different internal mechanism to achieve the permanent angular displacement of cap outer part 14. This embodiment is functionally equivalent to the first embodiment in the sense that the same large, about one quarter turn, permanent angular displacement of outer part 14 is obtainable when the cap assembly is first opened. This embodiment is also suitable for use with or without a sealing disc 19.

A cap assembly 55 is shown in FIGS. 6–9 inclusive. An inner part 56 includes a cylindrical wall 57 which is divided into two sections by a flat wall 58. The lower section comprising internal threads 60 and a sealing disc 19 the same as described in the first embodiment of FIGS. 1 and 2. The upper section contains two projections 61, 62 which are attached at one end to wall 57 and at the base to wall 58. Attached to projections 61, 62 are two arms 63, 64 respectively which are symmetrically placed about the center line. Arms 63, 64 are flexible and are attached to projections 61, 62 respectively at junctures 65, 66 respectively. Arms 63, 64 can bend freely in either direction, in the manner of a cantilever, as the arms are not attached to wall 58 at the base. Arms 63, 64 form gaps 67, 68 respectively with the wall of inner part 56. Around the periphery of inner part 56, a projection 70 of rectangular cross-section extends around the entire circumference. The outer part 71 is a cylindrical wall 72 closed at the upper end by a flat wall 73. On the inside of cylinder wall 72 is a groove 74 of rectangular cross-section which extends around the entire circumference. Projecting part of the way down from the inside of wall 73 are two blades 75 and 76. The inner part 56 is made from flexible material and the outer part 71 from a rigid and hard material.

The inner part 56 and outer part 71 are assembled by press-fitting together. Blades 75 and 76 project into the space provided between arms 63, 64 and the cylindrical wall of inner part 56. The gaps 67, 68 are narrower than the width of blades 75, 76.

The cap assembly of FIG. 6 is screwed on the filled container and tightened at the initial closing by rotating the outer part 71 in a clockwise direction. The rotational force applied to outer part 71 is imparted to the inner part 56 by contact between blade 75 and projection 61 and, simultaneously, between blade 76 and projection 62. The inner part 56 is thus screwed on via the threads 60 and tightened.

The operation of the cap assembly mechanism at the first opening will now be described. The initial position of the cap assembly is that shown in FIG. 7. The cap assembly is unscrewed by rotating outer part 71 in a counterclockwise direction as shown in FIG. 8. Rotation of outer part 71 causes blade 75 to bend flexible arm 63 downward as shown in broken lines and travel through gap 67. Simultaneously, blade 76 bends arm 64 upwards and passes through gap 68. Because the two arms 63, 64 are relatively flexible, little force is required to move blades 75, 76 through their respective gaps 67, 68 and the slight bending of arms 63, 64 does not move the tightly closed inner part 56. Continued counterclockwise rotation causes blade 75 to push against projection 62. Simultaneously, blade 76 pushes against projection 61. The blades 75, 76 impart balanced rotational force to the inner part 56 so that it will be unscrewed. This opening phase is illustrated by the sectional view of the cap assembly in FIG. 8. On subsequent closure of the container, the outer part 72 of the cap assembly is rotated again in a clockwise direction as shown in FIG. 9. Because of the crucial fact that gaps 67, 68 are narrower than the width of blades 75, 76 respectively, the blades will not pass through the gaps in the reverse direction. Instead, arm 64 will be bent downwards by blade 76. Simultaneously, arm 63 will be bent upwards by blade 75. As the rotational force on outer part 76 in the clockwise direction is increased, the ends of arms 63, 64 will be forced hard against the cylindrical wall of inner part 56, imparting rotational force in the same direction thereto, so that it will be screwed on again and tightened. After tightening, while the inner part 56 returns to its initial position, FIG. 7, outer part 72 has been displaced about a quarter turn (or about 90°) from its initial or starting position. The blades 75, 76 are permanently confined in the open space between arms 63, 64 and the second position has been reached. Subsequent openings will be by the contact of blades 75, 76 with projections 62, 61 respectively as shown in FIG. 8; subsequent closings by the contact of blades 75, 76 with the arms 63, 64 respectively, as shown in FIG. 9.

Besides acting as one-way gates, arms 63, 64 as in FIG. 7, also confine blades 75, 76 within quite narrow limits in the small compartment that arms 63, 64 form within the inside face on inner part 56. This feature enables the initial position of outer cylinder 72 to be clearly defined. A pair of arrows such as 50, 51 in FIG. 5*a* can be used as visual indicators in the manner described previously.

Still another version of the invention uses a different technique to detect the first removal of a container cap than the preceding version and is shown in FIGS. 10–13 inclusive. This version, however, does have some common features with the preceding version. For example, wedges are used which first engage in a flexible manner when they slide past each other and, subsequently, in a stiff manner when they interlock. Also, there are external arrows on the cap and container neck to serve as visual indicators. This version is simple in concept and can be implemented with minor modifications to conventional containers and caps.

The version shown in FIGS. 10–13 inclusive utilizes one or more physical barriers to generate resistance opposing the first unscrewing of a container cap. During the first unscrewing of the cap, as a physical barrier is encountered, additional rotational force must be applied to the cap to overcome the barrier and, subsequently, remove the cap. This additional force which may be predetermined can be easily sensed by the person unscrewing the cap. In addition, the location at which a barrier will be encountered can be visually identified as an aid. As the cap is unscrewed, encountering firm resistance at these barrier locations indicates an intact container. Conversely, absence of resistance at these barrier locations indicates prior opening and serves as a warning signal to reject the container. Because the mechanism used to create these barriers is entirely inside the capped container, it cannot be circumvented. To overcome these internal barriers requires breaking off certain internal parts. Since this occurs only at the first opening, it is uniquely identifiable.

Figure 11:
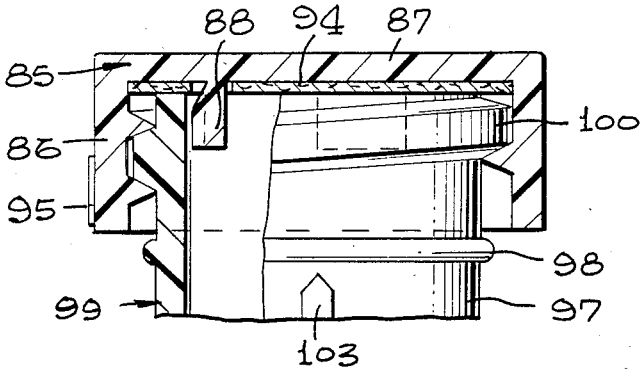
Figure 13:
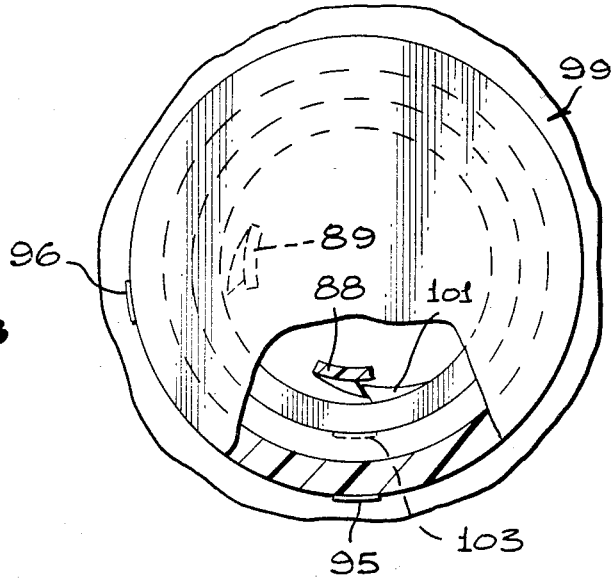

The cap and container are shown in the views of FIGS. 10–13 inclusive. The cap 85 consists of a cylindrical wall 86 which is threaded on the inside and closed at the top end by a flat wall 87. From the inside of wall 87, two similar arcuate segments 88, 89 project inwardly. The segments 88,89 have similar wedges 90, 91 respectively on their outward facing sides, with slightly convex curvature, terminating in acute angles 92, 93 respectively. The wedges extend vertically part of the way down their respective segments and then taper rapidly at the base to the thickness of the segments. The segments 88, 89 are designed to shear off at the base with a predetermined force. When segments 88, 89 shear off, provision can be made in the design for them to remain loosely attached to wall 87 to prevent them from falling into the container. Alternatively, segments 88, 89 can be designed to shear off completely and fall into the container if desired. The predetermined force required to shear off segments 88, 89 can be insured by choosing a suitable cross-section for segments 88, 89. A useful method to obtain the desired segment cross-section, and also insure consistency in the required shear force, may be to undercut the segments longitudinally at their base so that they will shear off along the plane of the undercut. The cap 85 is shown in FIG. 11 with a sealing disc 94. If a sealing disc 94 is used, provision must be made to allow segments 88, 89 with their respective wedges 90, 91 to project through sealing disc 94, by punching suitable holes in sealing disc or using a sealing ring. Cap 85 can also be used without a sealing disc, if desired. On the outside surface of cylindrical wall 86 are embossed two downward pointing arrows 95, 96 where mating contact will occur. The cap 85 is made from a flexible material.

The cap 85 is shown screwed onto a typical container 99. The container 99 has a neck 97 on which there is a typical rounded projection 98. Also on the neck, there is a typical single turn, fairly coarse thread 100. The cap 85 unscrews from neck 97 in typically less than one turn. On the inside of the container neck there is a wedge 101 with slightly concave curvature and a similar acute angle 102 as acute angles 92, 93. The wedge 101 is substantially flush with the top of the container neck and extends partially down the inside surface of the neck. On the outside surface of the container neck, an upward pointing arrow 103 is embossed to correspond with the projecting end of wedge 101. The container is made from a hard and rigid material.

In operation, the cap 85 is screwed onto the filled container 96 and tightened at the initial closing. During this phase, the cap is rotated in the clockwise direction. First, wedge 91 slides past wedge 101, bending segment 89 inwards. Because the cap is made from a flexible material and the width of segments 88, 89 is quite narrow, segments 88, 89 require little force to bend them inwards. After wedge 91 has passed wedge 101, segment 89 snaps back to its original position. Continuing the clockwise rotation of cap 85 causes the above procedure to be repeated with the next wedge 90, and the cap is then tightened. The cap is shown in the initial closed position in FIG. 12.

The operation of the cap during the first opening will now be described. To open the container, the cap is rotated in a counterclockwise direction. Because of substantial overlap, the protruding ends of wedges 90, 101 will interlock and impede further counterclockwise rotation. This situation is shown in the plan view of the cap in FIG. 13. Simultaneously, the arrow 95 on the outer face of cylinder 86 will align with arrow 103 on the container neck as shown in the view of the container and cap assembly in FIGS. 10 and 13. The alignment of the arrows 95, 103 indicates the first location at which resistance will be encountered. Increasing the rotational force on the cap in the counterclockwise direction will cause wedges 90, 101 to lock more firmly together because of the acute angle design of their contacting faces. When the rotational force reaches the shear force predetermined by design, segment 88 will shear off at the base. The cap is then free again to continue rotating in the counterclockwise direction until wedge 91 encounters wedge 101 and the above procedure is repeated. In this case, the alignment of arrows 96, 103 indicates the second location at which resistance will be encountered. After segment 89 has been sheared off at the base, the cap can be completely unscrewed. Subsequent closing and opening of cap 85 is similar to that of conventional caps. To alert the user to the warning function of cap 85, a message such as "REJECT IF NO FIRM RESISTANCE ENCOUNTERED WHEN ARROWS ALIGN" can be embossed on the outside surface of wall 87.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A closure assembly for a container comprising:

a closure cap having a first position relative to the container signifying an initially unopened position and a second position relative to the container signifying an opened or pre-tampered position;

angular displacement indicating marker means cooperatively carried on said closure cap and said container designating said closure cap in either one of said first or second positions; and said marker means includes reference indicia displayed on said container and on said closure cap whereby angular displacement separates said respective indicia in spaced-apart relationship.

2. The invention as defined in claim 1 wherein:

said closure cap having at least one latch closure system having a closure portion detachably disposed on said container and a cover portion movably carried on said closure portion; and interference means cooperatively disposed between said closure portion and said cover portion adapted to forcibly engage and yeldably respond when said cover portion is moved on said closure portion beyond limits of said interference means.

3. The invention as defined in claim 2 wherein:

said interference means includes yieldable segments adapted to engage and snap-lock in response to movement of said cover portion respective of said closure portion.

4. The invention as defined in claim 3 wherein:

said segments includes a plurality of spaced apart elements downwardly depending from the underside of said cover portion and a plurality of spaced apart elements upwardly disposed on said closure portion arranged to interfere with said cover portion elements when said cover portion is moved between said positions.

5. The invention as defined in claim 4 wherein:

said cover portion and said closure portion include a ratchet-like means for driving said closure portion in a single direction by said cover portion.

6. The invention as defined in claim 5 wherein:

said marker means includes a visual indicator carried on said cap and a visual indicator on said container whereby alignment of said indicators represents said first position and non-alignment of said indicators represents said second position.

7. The invention as defined in claim 5 wherein:

said latch closure system is a double latch closure providing noticeable resistance to the user in moving said cap portion from said first position to said second position.

* * * * *